US010377032B1

(12) United States Patent
Kadosh

(10) Patent No.: US 10,377,032 B1
(45) Date of Patent: Aug. 13, 2019

(54) SAWHORSE TABLE WITH A QUICK LOCK-RELEASE MECHANISM

(71) Applicant: Yariv Kadosh, Tel Aviv (IL)

(72) Inventor: Yariv Kadosh, Tel Aviv (IL)

( * ) Notice: Subject to any disclaimer, the term of this patent is extended or adjusted under 35 U.S.C. 154(b) by 0 days.

(21) Appl. No.: 16/130,153

(22) Filed: Sep. 13, 2018

(51) Int. Cl.
*B25H 1/04* (2006.01)
*B25H 1/06* (2006.01)

(52) U.S. Cl.
CPC ..... *B25H 1/04* (2013.01); *B25H 1/06* (2013.01)

(58) Field of Classification Search
CPC ... B25H 1/04; B25H 1/06; B25H 1/14; B25H 1/16; A47B 3/06; A47B 3/12; A47B 13/021
See application file for complete search history.

(56) References Cited

U.S. PATENT DOCUMENTS 5,007,502 A * 4/1991 Shapiro ..... B25H 1/06 182/151
5,439,073 A * 8/1995 Johnson ..... A47B 3/0818 182/153
7,992,683 B2 * 8/2011 Stephens ..... B25H 1/06 182/151
2010/0288585 A1 * 11/2010 Katz ..... B25H 1/04 182/155
2011/0061573 A1 * 3/2011 Wright ..... A47B 3/0818 108/132
2017/0106527 A1 * 4/2017 Birnbaum ..... B25H 1/0042
2017/0334059 A1 * 11/2017 Moffat ..... B25H 1/16

* cited by examiner

*Primary Examiner* — Daniel J Rohrhoff

(57) ABSTRACT

A sawhorse table that includes a table top plate includes a pair of longitudinal sides and a top plate, two trestles legs that each of them include a top horizontal beam, and a quick lock-release mechanisms that enables a user to lock and release the table top plate onto and from the trestles legs. The quick lock-release mechanisms include four longitudinal profiles wherein each of them has a bottom slope, and four resilient locking tabs and each of them has an upper slope. The resilient locking tabs are assembled and connected to the top horizontal beams.

1 Claim, 7 Drawing Sheets

SAWHORSE TABLE WITH A QUICK LOCK-RELEASE MECHANISM

TECHNICAL FIELD

The present invention refers to a sawhorse table that include a Quick Lock-Release mechanisms for a quick locking and releasing the table top plate from the trestles legs.

BACKGROUND ART

Standard sawhorse table comprises a table top plate and trestles legs, which are designed to be assembled together for use and disassembled after use. Another kind of sawhorse table comprises a table top plate that is fixed permanently to the legs, and this kind is not the issue of the present invention. The invention subject matter of the present patent application discloses a sawhorse table that includes Quick Lock-Release mechanisms for locking the table top plate onto the trestles legs and releasing the table top plate from the trestles legs in a quick and simple manner.

LIST OF DRAWINGS

The intention of the drawings attached to the application is not to limit the scope of the invention and its application. The drawings are intended only to illustrate the invention and constitute only one of its many possible implementations.

THE INVENTION

The main objective of the present invention is to provide a sawhorse table (1) that includes a table top plate (10), trestles legs (20), and a quick Lock-Release mechanisms (30) for locking the table top plate (10) onto the trestles legs (20) and releasing the table top plate (10) from the trestles legs (20) in a quick and simple manner.

Figure 1:
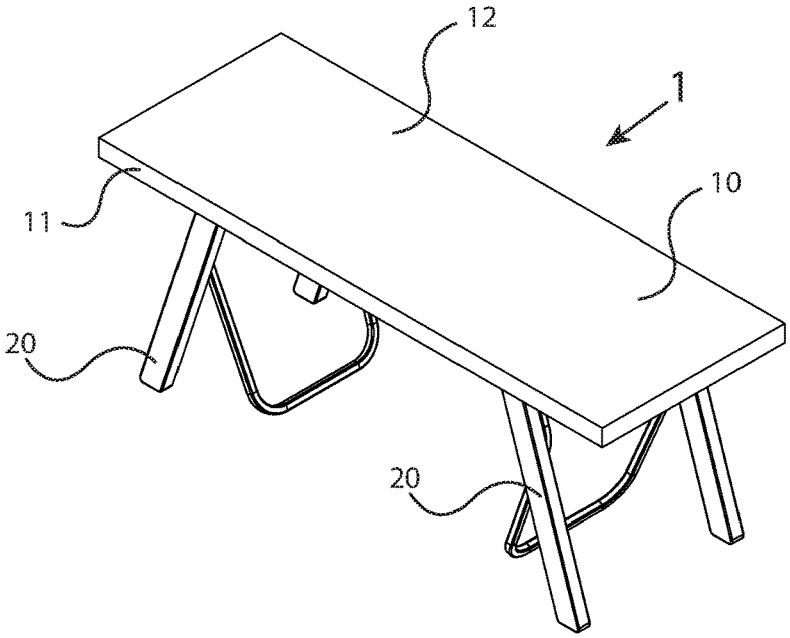
FIG. 1 depicts the sawhorse table (1).
Figure 2:
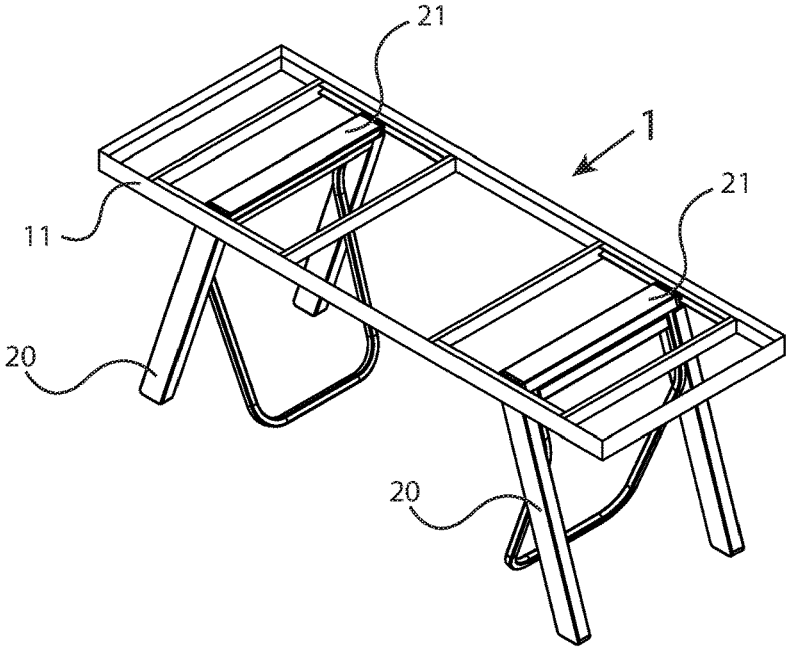
FIG. 2 depicts the sawhorse table (1) without the top plate (12).

The table top plate (10) includes a pair of longitudinal sides (11) and a top plate (12). The trestles legs (20) include a top horizontal beam (21). FIG. 1 depicts the sawhorse table (1). FIG. 2 depicts the sawhorse table (1) without the top plate (12).

In general, the sawhorse table (1), i.e. the table top plate (10) and the trestles legs (20), may be designed in the same manner as standard sawhorse tables, and the innovative aspect of the sawhorse table (1) subject matter of the present invention is the quick Lock-Release mechanisms (30). The trestles legs (20) may be designed in general as standard known trestles legs, for example, they may be collapsible.

Figure 3:
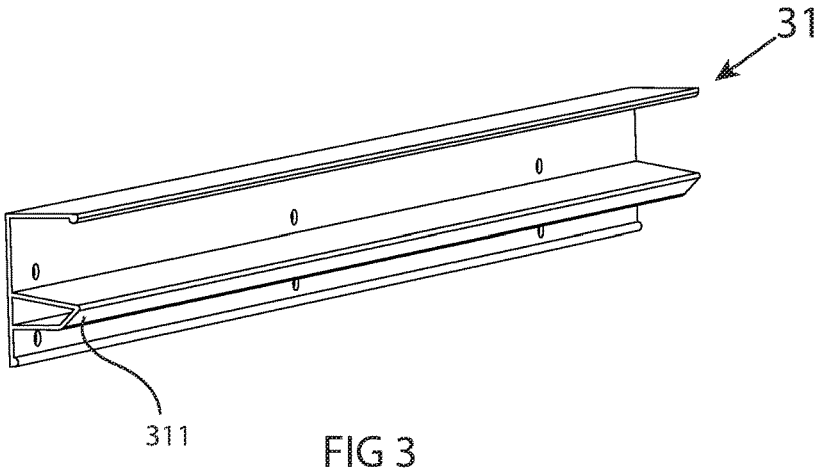
FIG. 3 depicts the longitudinal profile (31).
Figure 4A:
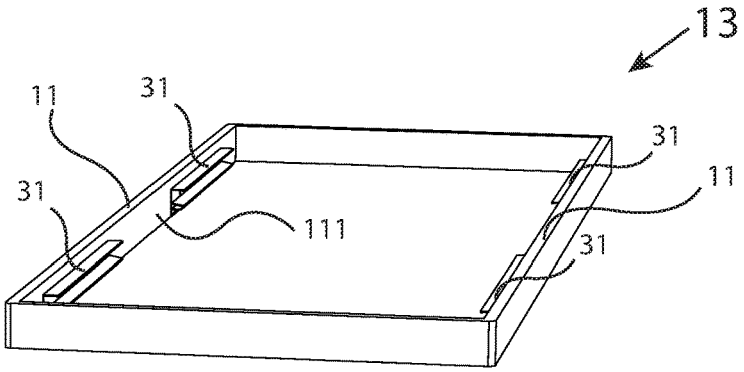
FIGS. 4A and 4B depict the top frame (13) of the table top plate (10).
Figure 4B:
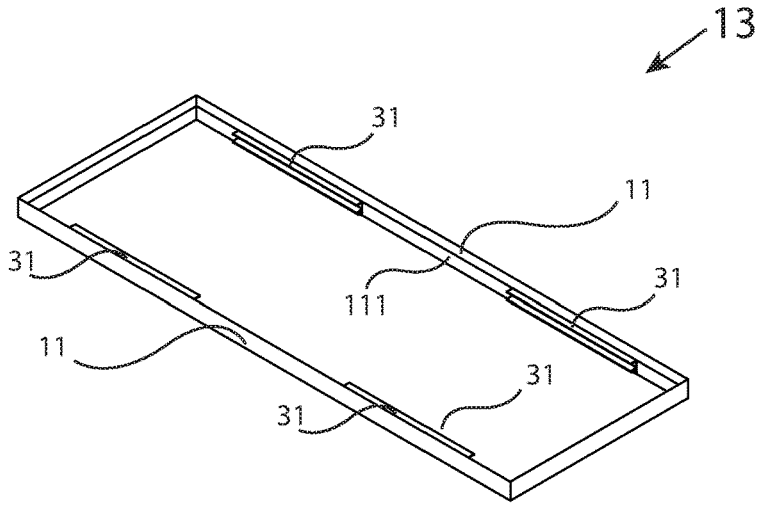

The quick Lock-Release mechanisms (30) include four longitudinal profiles (31) that each of them has a bottom slope (311), and four resilient locking tabs (32) that each of them has an upper slope (321). FIG. 3 depicts the longitudinal profile (31). FIGS. 4A and 4B depict a top frame (13) of the table top plate (10) with the pair of longitudinal sides (11) that to their internal sides (111) the longitudinal profiles (31) are attached.

Figure 5A:
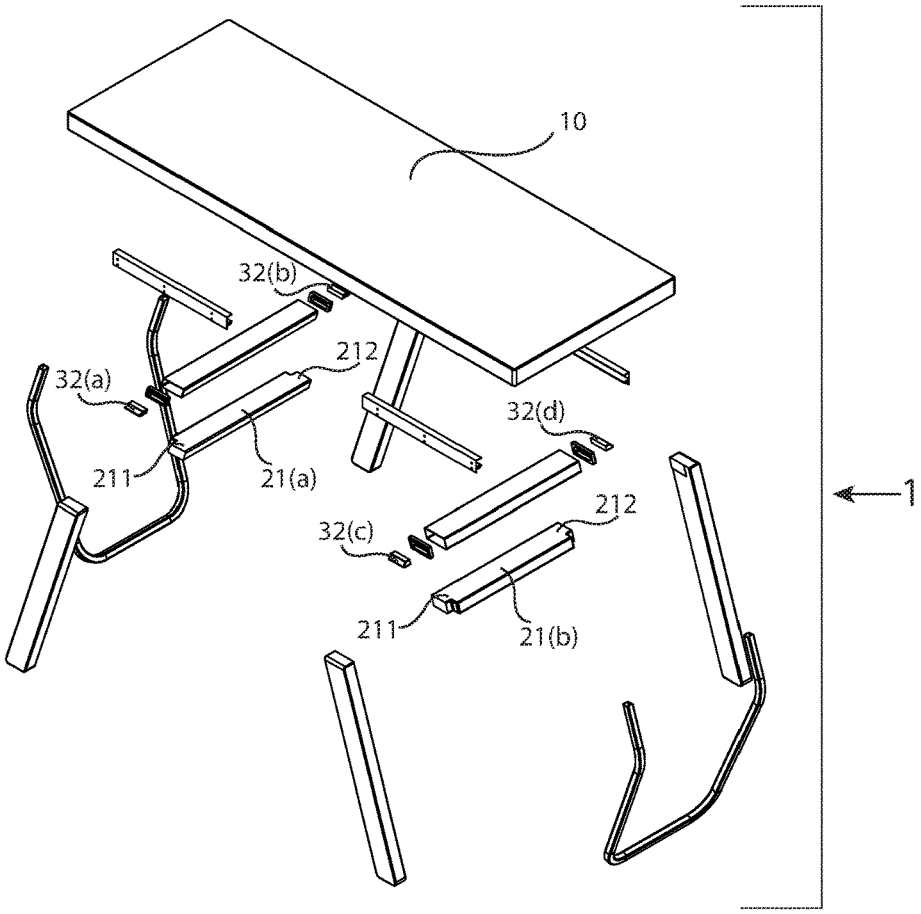
FIGS. 5A and 5B are an exploded illustration of the sawhorse table (1).
Figure 5B:
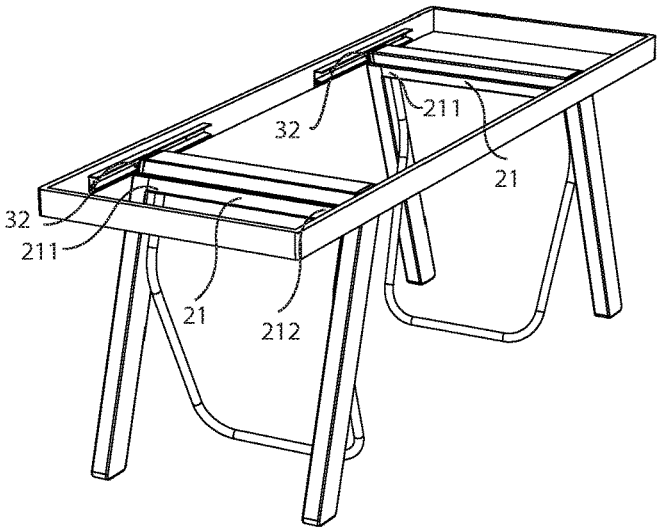

The resilient locking tabs (32) are assembled and connected to the top horizontal beams (21). The first and the second resilient locking tabs (32*a*) and (32*b*) are connected to the first beam (21*a*) and the third and fourth resilient locking tabs (32*c*) and 32(*d*) to the second beam (21*b*). The first tab (32*a*) near the first end of the first beam (211) and a second tab (32*b*) near the second end of the first beam (212) and the same in the second beam (21*b*), as depicted for example in FIGS. 5A and 5B which is an exploded illustration of the sawhorse table (1). Each resilient locking tab (32) is enclosed within a frame (322) with a spring (323) in a way that the spring pushes the tab (32) outwardly.

Figure 6:
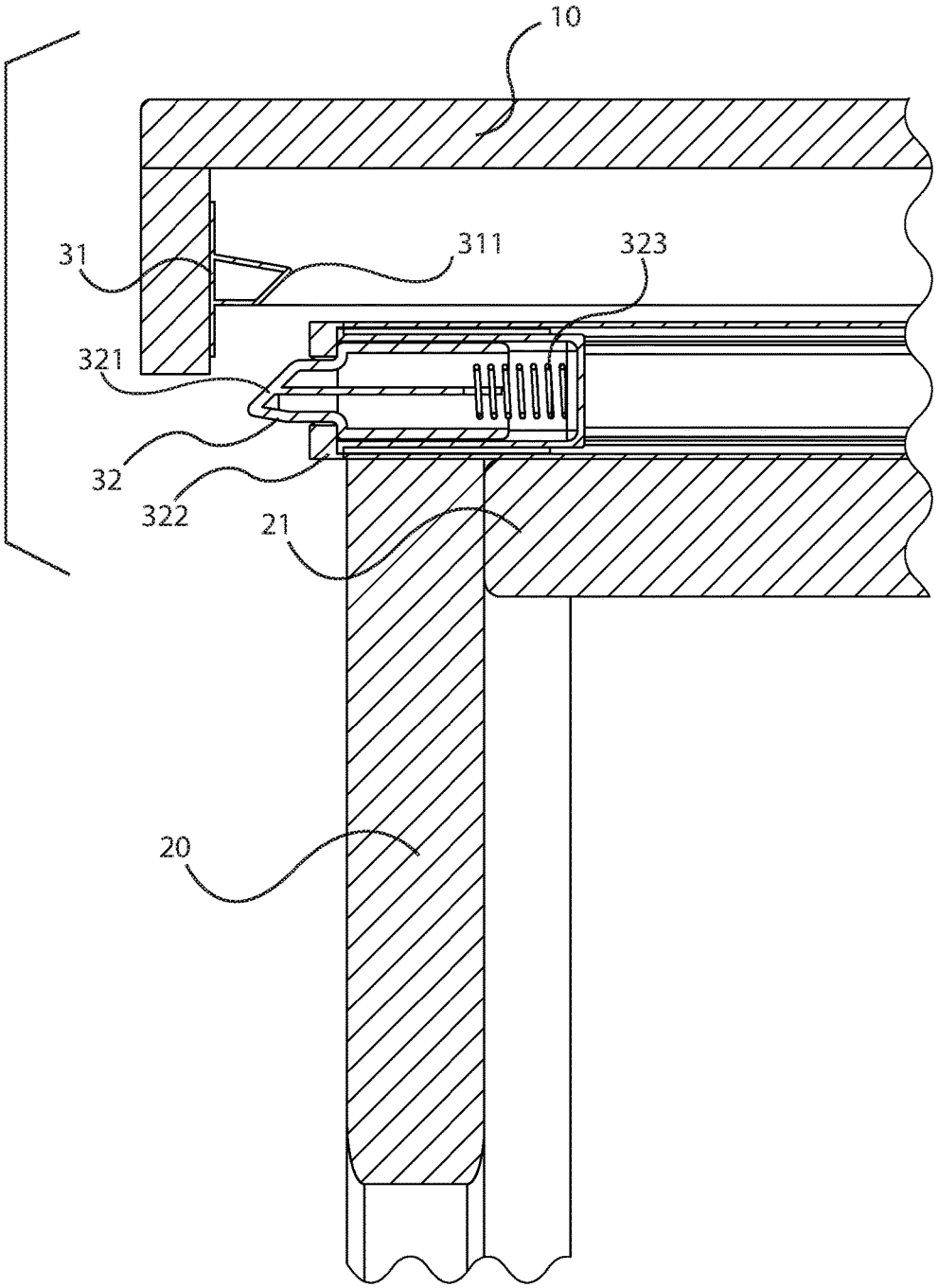
FIGS. 6-8 are a cross sectional view of part of the sawhorse table (1) that depicts the longitudinal profile (31) and the resilient locking tab (32).
Figure 7:
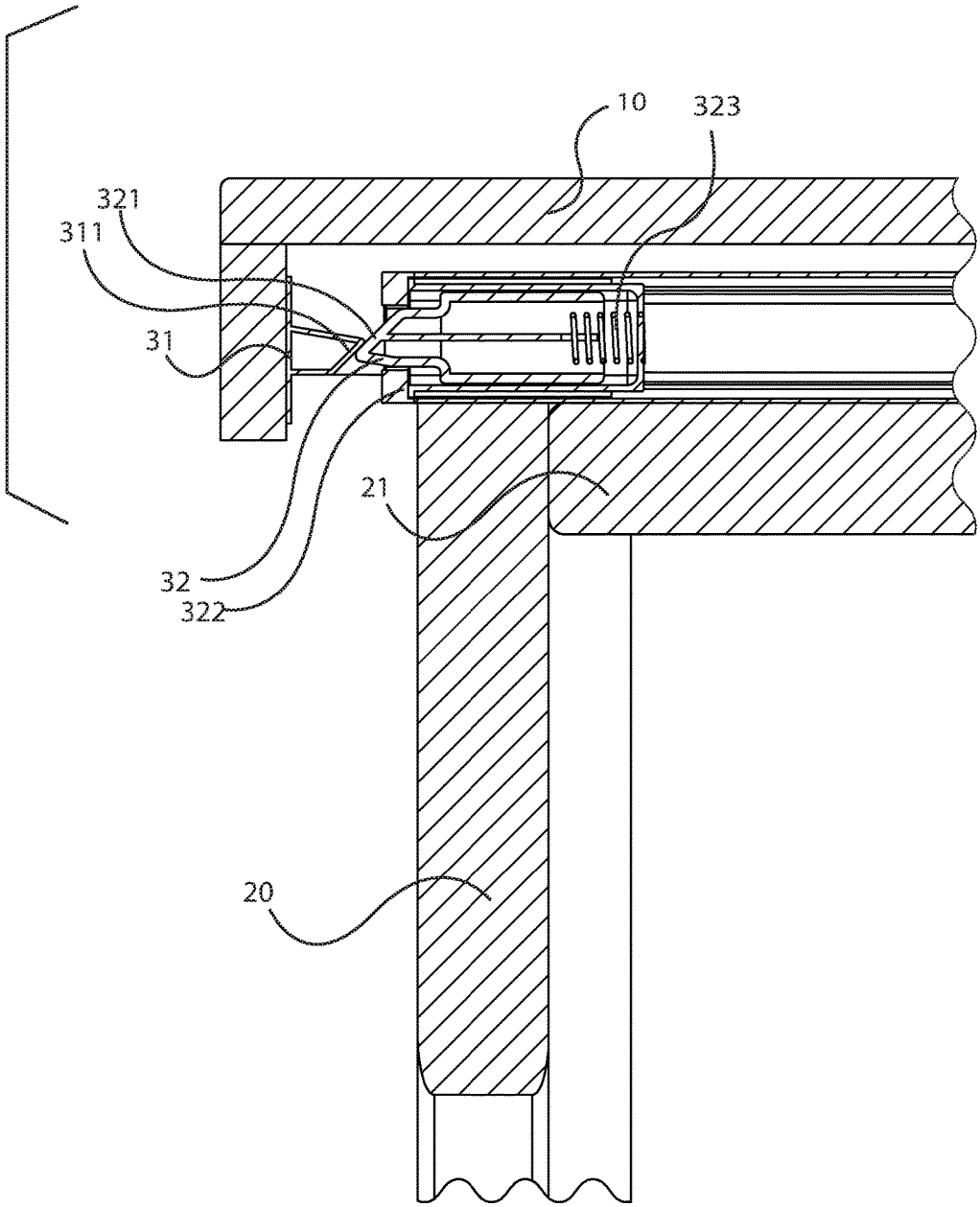

FIG. 6 is a cross sectional view of part of the sawhorse table (1) that depicts the longitudinal profile (31) with the bottom slope (311), the tope horizontal beam (21), the resilient locking tab (32) with the upper slope (321), the frame (322) and the spring (323). FIG. 6 depicts the situation when the user is going to put the table tope plate (10) on the trestles legs (20) and before the tabs (32) are locked and positioned onto the longitudinal profiles (31). When the plate (10) in putted down on the legs (20) the bottom slopes (311) of the profiles (31) press on the upper slopes (321) of the tabs (32) and push them inward as depicted in FIG. 7 for example.

Figure 8:
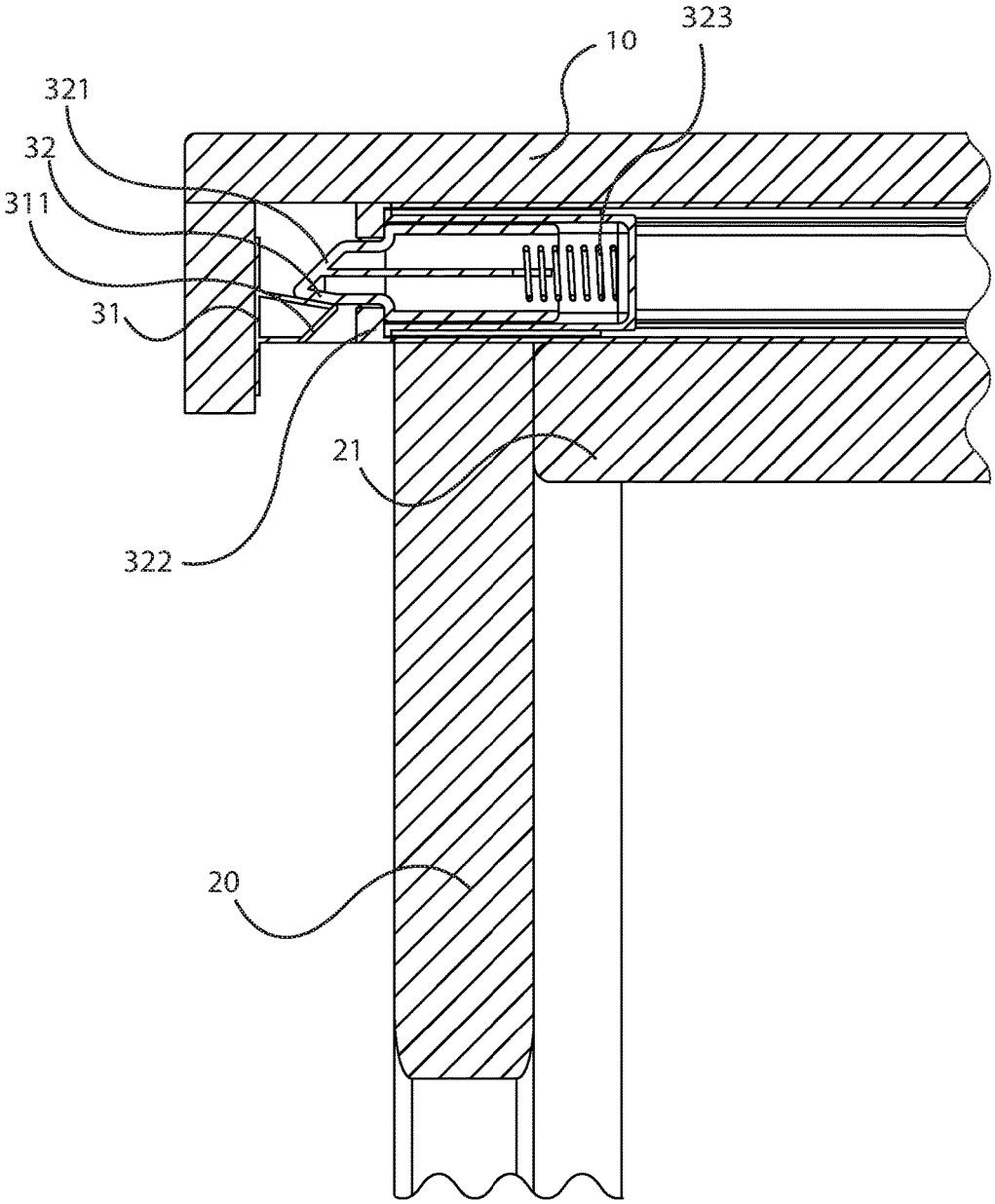

FIG. 8 depicts the situation when the table top plate is locked onto the trestles legs (20). In this position, the user can lift all the table (1) including the legs (20) simply by holding and lifting the table top plate (10), this since the legs (20) are combined with the table top plate (10). Thus, the user can move the table (1) from one place to another easily even when placed on it food or other things. This is in opposite to the standard sawhorse tables that the user needs to move the top plate separately from the legs.

Figure 9:
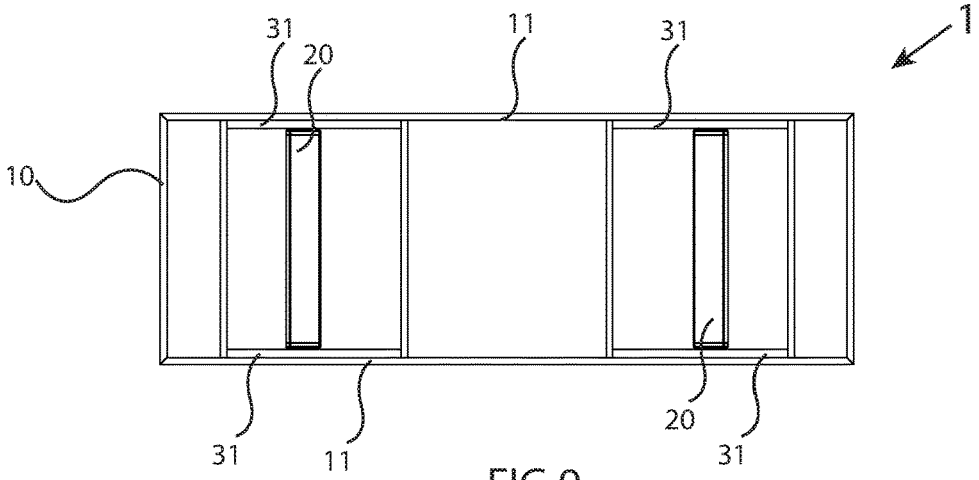
FIGS. 9-11 illustrate the top view of the table (1) without the top plate (12) and the trestles legs (20).
Figure 10:
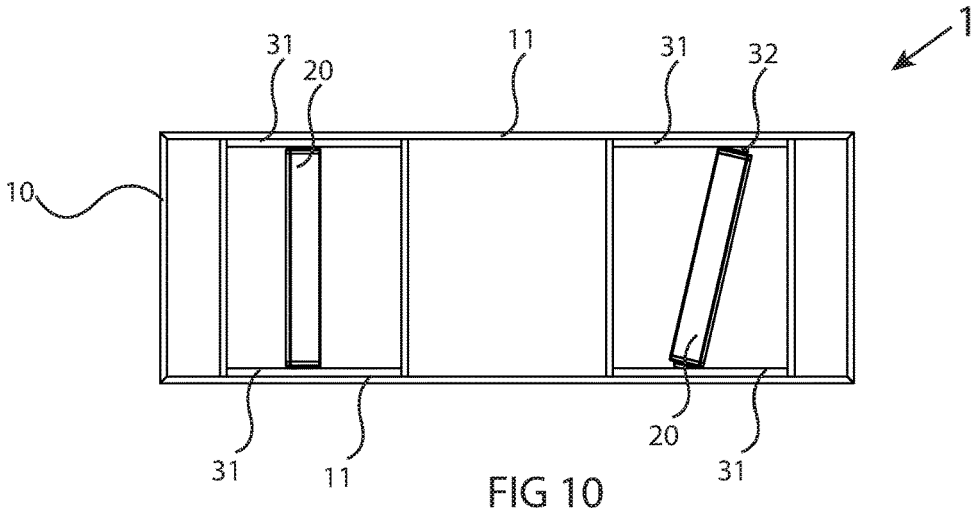
Figure 11:
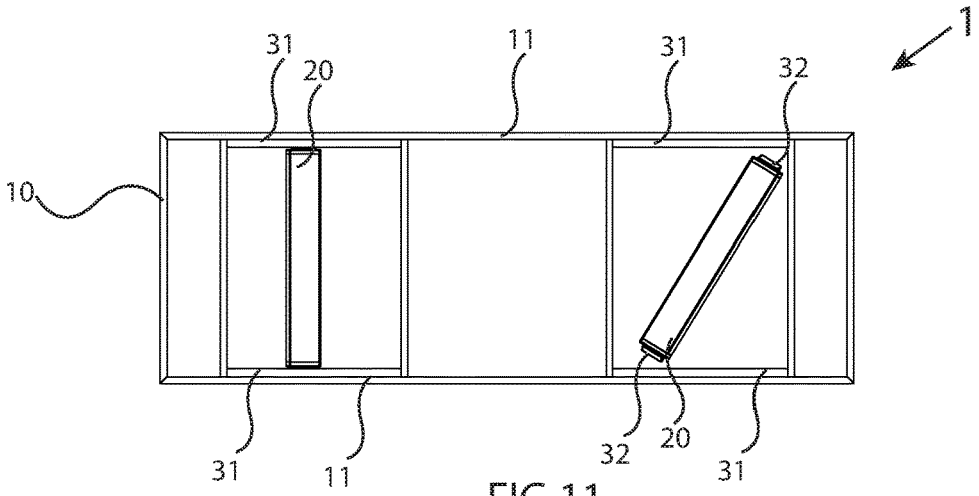

FIG. 9 illustrated the tope view of the table (1), without the top plate (12), when the table top plate (10) is locked on the legs (20). To release the table top plate (10) from the trestles legs (20) the user can rotate a bit the legs as depicted in FIG. 10 until the position as depicted in FIG. 11 in which the tabs (32) are no longer on the profiles (31) and then the user can simply lift the table top plate (10) from the trestles legs (20).

What is claimed is:

1. A sawhorse table, comprising: a table top plate including a pair of longitudinal sides and a top plate, two trestles legs that each of them include a top horizontal beam and a quick lock-release mechanisms that enables a user to lock and release the table top plate onto and from the trestles legs;

wherein each of said quick lock-release mechanisms includes four longitudinal profiles wherein each of them has a bottom slope, and four resilient locking tabs wherein each of them has an upper slope; wherein the four longitudinal profiles are attached to internal sides of the longitudinal sides of the table top plate; and wherein the four resilient locking tabs are assembled and connected to the top horizontal beams.

* * * * *